US006579189B2

(12) United States Patent
Anzaldua

(10) Patent No.: US 6,579,189 B2
(45) **Date of Patent: *Jun. 17, 2003**

(54) MOBILE GOLF PRACTICE DEVICE

(76) Inventor: Ronald R. Anzaldua, 8278 W. Eastman Pl., Lakewood, CO (US) 80227

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/406,261

(22) Filed: Sep. 24, 1999

(65) Prior Publication Data

US 2002/0077188 A1 Jun. 20, 2002

(51) Int. Cl.[7] ..... A63B 57/00
(52) U.S. Cl. ..... 473/139; 473/142
(58) Field of Search ..... 473/481, 482, 473/483, 142, 143, 139, 429; 224/488, 519

(56) References Cited

U.S. PATENT DOCUMENTS

| | | | | | |
|---|---|---|---|---|---|
| 1,732,971 | A | * | 10/1929 | Kappeler | 473/143 |
| 2,305,187 | A | | 12/1942 | Neiden | |
| 2,510,266 | A | | 6/1950 | Taylor | |
| 2,929,632 | A | * | 3/1960 | Moffatt | 473/142 |
| 3,169,771 | A | | 2/1965 | Holmes | |
| 3,656,759 | A | | 4/1972 | Hall | |
| 3,731,926 | A | | 5/1973 | Vincent | |
| 3,851,886 | A | | 12/1974 | Acosta | |
| 4,932,660 | A | * | 6/1990 | Wang | 473/143 |
| 5,219,105 | A | * | 6/1993 | Kravitz | 224/519 |
| 5,244,392 | A | * | 9/1993 | Mausetter | 473/429 |
| 5,800,294 | A | * | 9/1998 | Naecker | 473/481 |
| 5,893,553 | A | | 4/1999 | Pinkous | |

* cited by examiner

*Primary Examiner*—Mark S. Graham
*Assistant Examiner*—Raeann Gordon
(74) *Attorney, Agent, or Firm*—Patton Boggs LLP

(57) ABSTRACT

A mobile golf practice device adapted for attachment to the bumper of a standard electric golf cart which allows a golfer to practice his or her stroke with the selected club, proximate the actual shot to be played. The device has an L shaped rigid shaft fixed attached to the cart bumper on one end and carrying a swivel on the other. A flexibly tethered golf ball is attached to the swivel such that the ball moves freely in a arc about the shaft when struck. By striking a golf ball and observing the motion of the ball as it orbits the shaft as well as the number of orbits the golfer can judge the effectiveness of the proposed shot in respect to his actual lie of the course.

7 Claims, 3 Drawing Sheets

MOBILE GOLF PRACTICE DEVICE

BACKGROUND OF THE INVENTION

1. Field of the Invention

The present invention relates to mobile golf practice devices which assist golfers in improving the accuracy of their stroke; and, more particularly, to a vehicle mounted device which allows a golfer to observe the correctness of his swing.

2. Description of the Related Art

Golf has become a national pastime. The paraphernalia that is available to the golfer is second to none. Although golf is very popular, and does not require a great deal of physical endurance, it is nevertheless a game of skill. Therefore, a number of devices have been offered to improve the golfer's swing, as well as his contact with the ball. For example, ergonomic putters are designed with the shaft attached to the head in the center of club, rather than at the end. Resin and graphite have replaced the old metal shaft. Adjustable club heads actually allow the golfer to adjust the head angle to correct for a slice or hook.

No matter how sophisticated the equipment gets, the fact of the matter is that a player's score is impacted most greatly by his swing and thus the way in which he addresses and strikes the golf ball. Therefore, many golf practice devices have been designed to allow stance and stroke practice at locations other than the golf course or the driving range. Some of these practice devices involve computerized imagery which use complicated software to simulate the path of the ball after it is hit. These are expensive and bulky. Others are more simple in design and attach to stationary objects or are attached to bases adapted to be driven into the ground. These devices incorporate, for example wiffle balls (hollow balls with holes in the surface), as well as actual golf balls that are tethered to extensions or arms such that they can be hit without having the golfer chase or otherwise retrieve the ball.

Thus, golf practice devices that attempt to help players improve their proficiency are well known in the art. Most of these devices are designed for use at home or at work. None of these practice devices are designed for use by the golfer near the hole that is about to be played i.e. is mobile so it can be used in the field of play prior to the golfer actually taking a shot. Thus, they cannot be set up so they are mobile to give a golfer the chance to practice under actual playing conditions with the club he or she is about to use.

For example, U.S. Pat. No. 2,929,632, issued to Moffatt shows a device for helping golfers practice their swing. The device has a hollow, golf-ball sized ball hung by a cord from one end of an L-shaped bar. The other end of the bar is firmly attached to the ground by a base plate that is anchored in the soil by two spikes on the bottom side of the plate. The Moffatt device provides a golfer with a device for practicing his or her stroke, but it is not mobile and can only be used in designated practice areas of a golf course. Golf courses limit the use of this device because of the holes the spikes create when they are pounded into the turf. Moreover, the device is cumbersome, and cannot be easily carried by a golfer from hole to hole during actual play.

While several patents have been issued on similar devices, none of these improved inventions can be used on the actual field of play. For example, UK Patent No. 1,263,269, issued to Hall discloses a mechanism which records and displays the number of times a struck ball rotates around the horizontal end of the L-shaped bar. Since the number of rotations is proportional to the club's impact force against the ball, golfers are able to estimate the power in their stroke and the distance an untethered golf ball would travel. U.S. Pat. No. 4,932,660, issued to Wang discloses a rotatable and pivotable component. The Wang device has sensors in the component that can record both the angle and force with which the ball leaves the club head. A golfer can use the data provided by the Wang device to make more precise estimates on the force of the stroke and the direction in which a ball travels.

None of these golf practice devices allow golfers to practice their stroke under conditions which most closely resemble those of actual play. These devices do not permit golfers to practice their stroke from the approximate location where they must make a shot that counts in the game. Moreover, since these devices are located far from the actual course, golfers must forfeit the opportunity to practice their stroke just before they make the actual shot. Thus, it would be advantageous to have a golf practice device that is fully portable on a golf cart and allows golfers to practice their stroke by striking a golf ball and observing the motion of the ball, yet is proximate the shot being played thus, allowing a golfer to practice from the approximate location where they will make the shot on the course.

SUMMARY OF THE INVENTION

The present invention provides for a mobile golf practice device which attaches, either removably or fixedly, to a mobile golfing vehicle, such as an electric golf cart. In the broad aspect, a support shaft is mounted upon a golfing vehicle at its one end and rotationally attaches to tethered golf ball on the other such that the golf ball is in position over the ground to be struck as if the ball were in play. In one aspect of the invention, the device attaches to a bumper on a golf cart used to caddy players and equipment from hole to hole on the course.

The mobile practice device of the present invention comprises a vehicle attachment means for attaching the device to a vehicle; a support shaft having a first end and a second end with the first end adapted for fixed attachment to the attachment means; and, a golf ball tethering means rotationally attached proximate the second end of the shaft, for allowing the golf ball to orbit the shaft after being struck by the golf club.

The vehicle attachment means preferably comprises a plate, and mounting brackets attached to the plate. The mounting brackets are preferably designed to grip the top and bottom sides of a bumper in order to immovably fix the plate to the bumper. The gripping force of the brackets on the bumpers is adjusted by tightening or loosening threaded fasteners that attach the brackets to the plate. The threaded fasteners include screws, bolts, hexagonal nuts and wing nuts. This preferred vehicle attachment means eliminates the need for holes to be placed in the bumper.

In another preferred aspect, the vehicle attachment means comprises a C-clamp. The c-clamp has an adjustable tightening lip, and a holding lip facing opposite to the adjustable tightening lip. The vehicle attachment means is immovably attached to the golf cart bumper by tightening down the adjustable tightening lip onto the bumper. Similar to the mounting brackets described above, this preferred attachment means does not require holes to be drilled directly into the bumper.

In another aspect, the vehicle attachment means comprises a plate that is immovably fixed to the bumper of a golf cart by at least one fastener. The plate is preferably made from wood, rigid plastic, composite metal, or the like and more preferably, the plate is made from stainless steel or aluminum. The plate is preferably fastened to the golf cart bumper by pins, bolts, screws, or a combination of these fasteners, that are drilled directly into the bumper. The plate may also be adhesively attached to the bumper.

The support shaft is preferably bent at a substantially right angle, making a L-shaped, rigid shaft. In this preferred aspect, the first section of the shaft points substantially perpendicular to the ground, and the second section is aligned substantially parallel with the ground and in play position points away from the golf cart. The shaft is attached to the vehicle attachment means, proximate to the first section of the shaft, by any known means for attaching a shaft to a plate, including pins, screws and other fasteners, clamps, and retaining rings. In a preferred aspect, the shaft can be adjusted such that the second section points substantially away from the golf cart, while a golfer is practicing, and points substantially parallel with the golf cart, while the cart is in motion i.e. the shaft swivels from one fixed position to another for storage.

In another aspect, a strait, unbent shaft, having a first end and a second end opposite the first, is attached to the vehicle attachment means and the tethering means. In this preferred aspect, the long axis of the shaft is aligned substantially parallel to the ground. The shaft is attached to the vehicle attachment means, proximate to the first end of the shaft by any known means for attaching a shaft to a plate, including pins, screws and other fasteners, clamps, retaining rings, welds, adhesives, and mating threads between the shaft and the plate. The golf ball tethering means is attached to the unbent shaft, proximate to its second end.

The shaft, either L-shaped or unbent, can be solid or hollow, and can be made from a wide variety of rigid materials, including wood, composites, plastics, metals or the like. In a preferred aspect, the shaft is made from stainless steel, aluminum, or fiberglass.

The golf ball tethering means is preferably flexible but could be rigid. The flexible tethering means is for example, a flexible cord or braided wire having a lower end attached to the ball which is preferably the size of a standard golf ball, and an upper end rotationally attached to the shaft proximate the second end. Preferably the upper end of the tether if fixedly attached to an oblate spool or pulley which prevents the cord from wrapping around the shaft when it is struck and the spool or pulley is rotatably fastened to the horizontal end of the support shaft. In order for the spool to rotate freely on the end of the shaft, a bearing, fixed to the end of the shaft, for example is inserted in the center portion of the spool. In this fashion the inner diameter surface of the spool moves rotatably around the outer diameter surface of the fixed bearing with a minimum of friction.

In another preferred aspect, the flexible golf ball tethering means includes a rotatable member and a connecting bar that is attached to the member. The member is mounted on the shaft at approximately the horizontal end of the shaft and rotatable about the long axis of the shaft. The connecting bar has a first end swivelled on the rotatable member and a second end extending downwardly from the rotatable member, where the ball is attached to this second end. In this preferred aspect of the tethering means, when a golfer hits the ball with a club, the ball and connecting bar rotate and pivot about the shaft until the ball loses enough momentum to come to a complete stop.

In another aspect the flexible golf ball tethering means comprises a flexible cord attached to a unit formed from a pair of ring shaped grommets, connected together by a tubular sleeve. The grommets are rotatably inserted upon the shaft, proximate the horizontal end of the shaft, and the upper end of the flexible cord is tied around the tubular sleeve. In order to prevent the grommets from sliding across the shaft, or sliding off the end of the shaft, a first and a second laterally spaced retainer are affixed to the shaft on opposite ends of the grommets. In order for the grommets and tubular sleeve to rotate freely about the long axis of the shaft, a first and a second washer, encircling the shaft, are positioned on opposite ends of the grommets, with each washer sandwiched between the end of a grommet and one of the laterally spaced retainers.

In still another preferred aspect, the flexible golf ball tethering means includes a flexible cord or rope with an upper end and a lower end. The upper end of the cord is attached to the shaft at approximately the horizontal end, and the lower end of the shaft is attached to the ball. When the ball is struck, the ball orbits the long axis of the shaft until the cord has completely wrapped itself around the shaft.

BRIEF DESCRIPTION OF THE DRAWINGS

The objects, features and advantages of the present invention will be apparent to one skilled in the art, in view of the following detailed description in which.

DETAILED DESCRIPTION OF THE INVENTION

Figure 1:
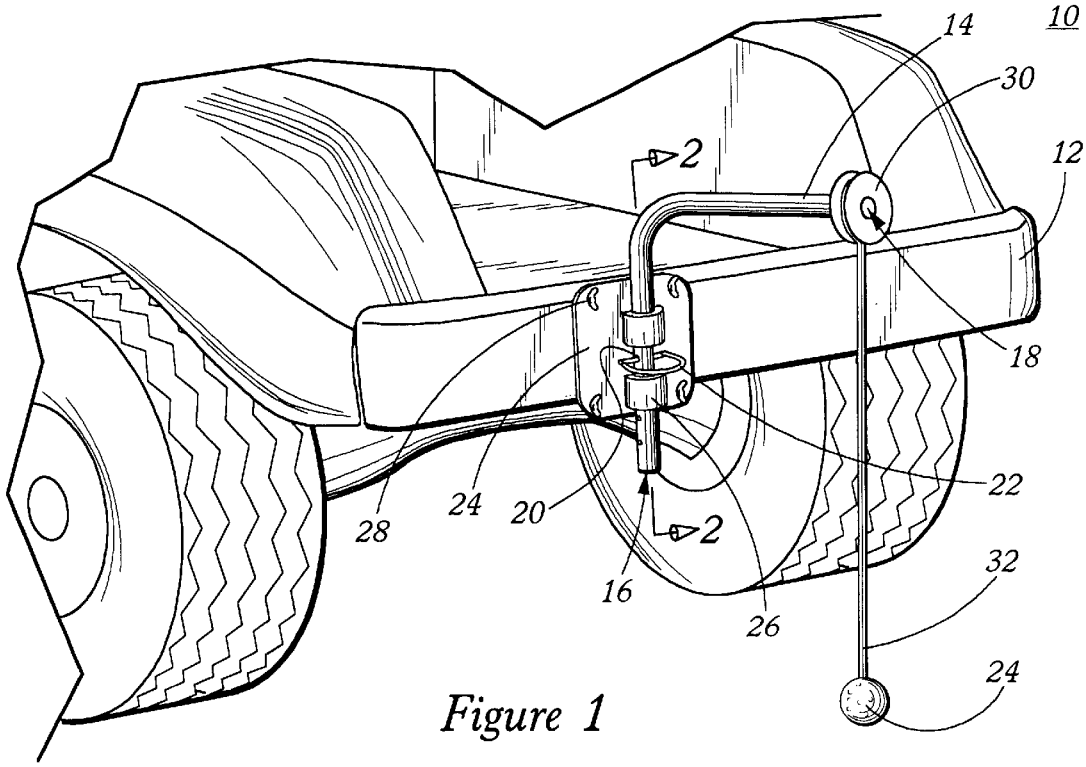
FIG. 1 illustrates a perspective view of a preferred embodiment of the mobile golf practice device of the present invention attached to the bumper of a golf cart.

Referring now to FIG. 1, a preferred aspect of the golf practice device 10 of the present invention is shown attached to the bumper 12 of a golf cart. The preferred practice device comprises a bent shaft 14 having a first end 16 pointing towards the ground, and a second end 18 oriented substantially parallel to the ground and facing opposite the golf cart. The shaft 14 has at least one opening 20, running through the shaft, into which a pin 22 can be inserted for adjusting the vertical position of the shaft with respect to the vehicle attachment means.

The preferred vehicle attachment means shown in FIG. 1 includes a plate 24 with a front side, and a back side opposite the front side that faces the bumper 12. A shaft holding means, comprising a pair of holding brackets 26, is attached to the front side of the plate 24. The first end 16 of the shaft 14 slidably inserts into the holding brackets 26 in order to attach the shaft 14 to the plate 24. As stated above, the vertical position of the shaft 14, with respect to the plate 24 and holding brackets 26, is fixed by inserting pin 22 into an opening 20 that is selected from a series of openings vertically aligned along the shaft 14. The pin 22, inserted through opening 20, also prevents the shaft 14 from swiveling inside the holding brackets 26, thereby fixing the orientation of the second end 18 to face opposite the golf cart.

The plate 24 is attached to the bumper 12 by means of mounting brackets (shown in FIG. 2) that clamp the plate 24 to the bumper 12. The mounting brackets can reversibly fix the plate 24 to the bumper 12 by the reversible tightening of wing nuts 28, located proximate to the four corners of the plate 24. Thus, when a golfer is finished using the golf cart, he may detach the practice device from the bumper 12 in order to take the device home. In this preferred aspect, the attachment means makes no permanent marks or holes in the golf cart bumper 12, when attaching the device to the bumper 12.

The preferred tethering means shown in FIG. 1 includes an oblate spool 30 that is positioned rotatably on the shaft 14, proximate to the second end 18. The top end of a flexible cord 32 is tied around the spool 30, while the bottom end of the cord 32 is attached to a golf ball 34. When a golfer strikes the golf ball 34 with a golf club, the ball 34 will spin in a orbit around the spool 30 (shown in FIG. 4).

Figure 2:
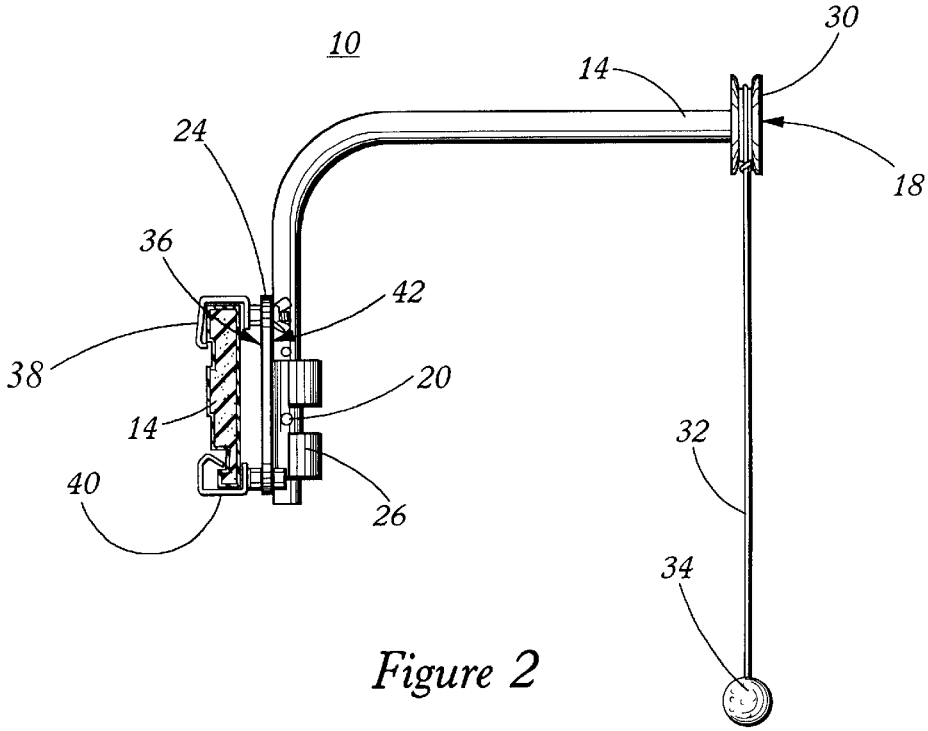
FIG. 2 illustrates a partial cross sectional view of the attachment device shown in FIG. 1 through lines 2—2.

Referring now to FIG. 2, a cross section of the preferred golf practice device attached to the golf cart bumper in FIG. 1 is shown. The back side 36 of the plate 24 is shown fastened to an upper mounting bracket 38 and a lower mounting bracket 40. In this preferred aspect, the mounting brackets, 38 and 40, are fastened to the plate 24 by four threaded bolts that are inserted through the mounting brackets, 38 and 40, and through the plate 24. The ends of the threaded bolts that extend through the plate 24 are secured by four nuts 28.

The nuts 28 can be tightened down against the front side 42 of plate 24 for immovably securing the mounting brackets, 38 and 40, to both the plate 24 and the golf cart bumper 12. The mounting brackets, 38 and 40, wrap around the top and bottom sides of the bumper 12 and each have a lip contacting the back side of the bumper 12. When the nuts 28 are tightened down on the front side 42 of plate 24, the lips of the mounting brackets, 38 and 40, are pressed against the back of the bumper 12, thereby immovably fixing the brackets, 38 and 40, to the bumper 12.

FIG. 2 also shows a series of vertical aligned openings 20 that extend through the shaft 14. As described in FIG. 1, the vertical position of the shaft 14, with respect to the plate 24 and the shaft holding brackets 26, can be adjusted by the selection of the opening 20 through which a pin (not shown) is inserted. For example, if a golfer desires to move the shaft 14 to the highest possible vertical position with respect to plate 24, he will insert the pin (not shown) through the opening 20 that is closest to the first end 16 of the shaft 14.

FIG. 2 additionally shows the tethering means of FIG. 1 from another vantage point. The oblate spool 30 of the tethering means is shown rotatably attached proximate to the second end 18 of the shaft 14. The top end of a flexible cord 32 is tied around the spool 30, while the bottom end of the cord 32 is attached to the golf ball 34.

Figure 3:
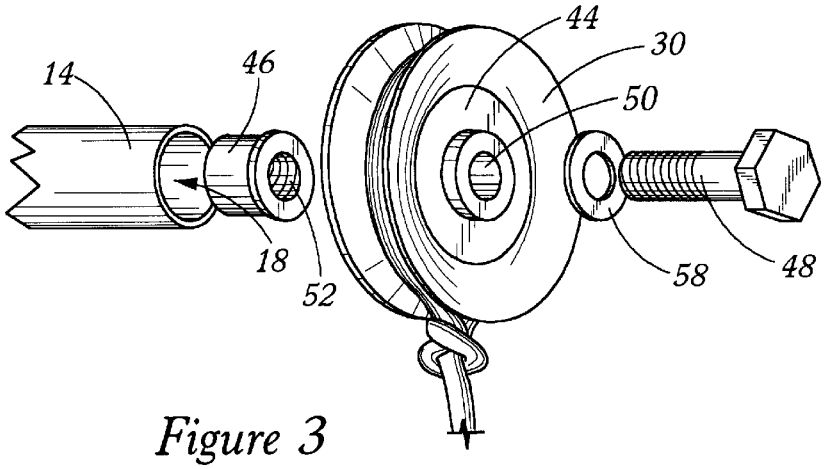
FIG. 3 illustrates an exploded view of the rotationally attaching means of FIG. 1.

Referring now to FIG. 3, a close-up view of the tethering means illustrated in FIG. 1 and FIG. 2 is shown. The tethering means includes an oblate spool 30 which is rotatable about a bearing 44 that is attached to the second end 18 of a shaft 14. In a preferred aspect, the bearing 44 is a sleeve bearing which has low friction materials, such as Teflon, slide against each other as the spool 30 rotates about the shaft 14. In another preferred aspect, the bearing 44 comprises ball bearings aligned along the circumference of the bearing 44, to allow the spool 30 to roll on the ball bearings 44 as it rotates.

In this illustrated aspect of the tethering means, the spool 30 is attached to the shaft 14 by inserting a well nut 46 into the hollow second end 18 of shaft 14, and then fastening a treaded bolt 48, inserted through bearing center 50, into the well nut center 52. The well nut 46 expands and immovably tightens against the inside wall of the shaft 14 as the bolt 48 is threadably inserted into the well nut center 52. A washer 58 may also be inserted between the bearing 44 and the head of the bolt 48.

Figure 4:
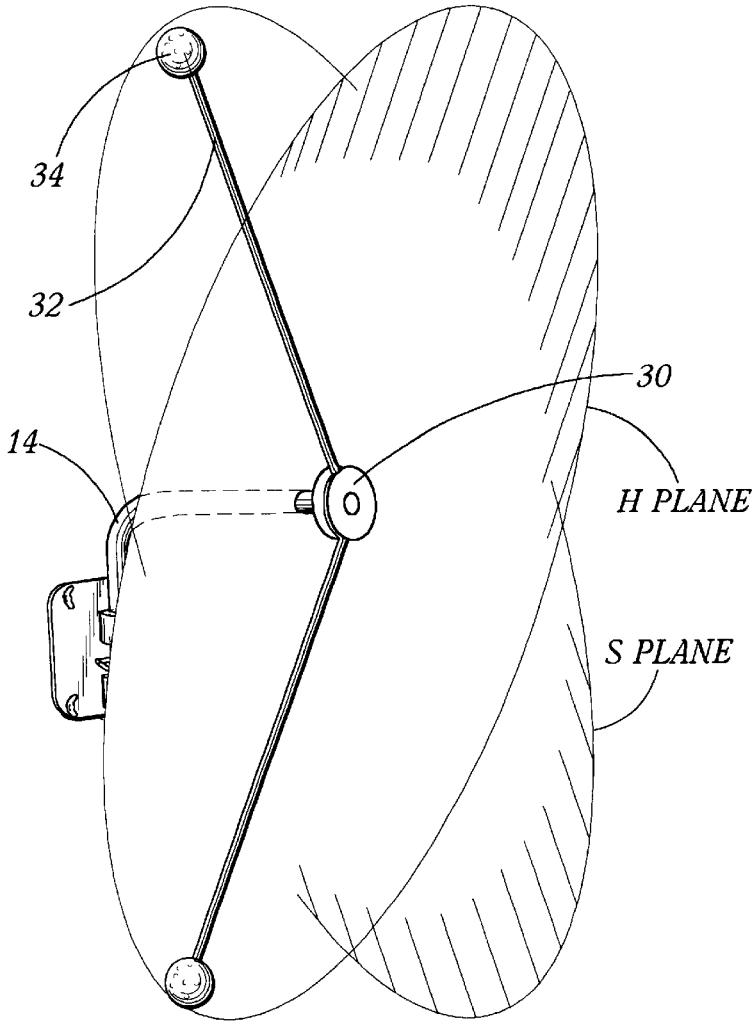
FIG. 4 illustrates two rotational planes (H and S) of a rotating golf ball that indicate to the golfer that the ball has hooked or sliced.

Referring now to FIG. 4, two rotational planes are illustrated which indicate that the golf ball 34 has been sliced (the S-plane) or hooked (the H-plane). When a right handed golfer (not shown) strikes the ball 34 from a direction opposite the shaft 14, such that the ball 34 hooks, then the ball 34, flexible cord 32 and spool 30 rotate about the shaft 14 in the H-plane. Similarly, when the golfer strikes the ball 34 such that it slices, the ball 34, flexible cord 32 and spool 30 rotate around the shaft in the S-plane. Alternatively, when a golfer strikes the ball 34 such that it travels in a perfectly strait direction, then the ball 34 will rotate in a plane (not shown) which is perpendicular to the long axis of shaft 14. Thus, a golfer can determine whether his stroke causes the ball 34 to hook, slice, or travel in a relatively strait-forward direction.

Figure 5:
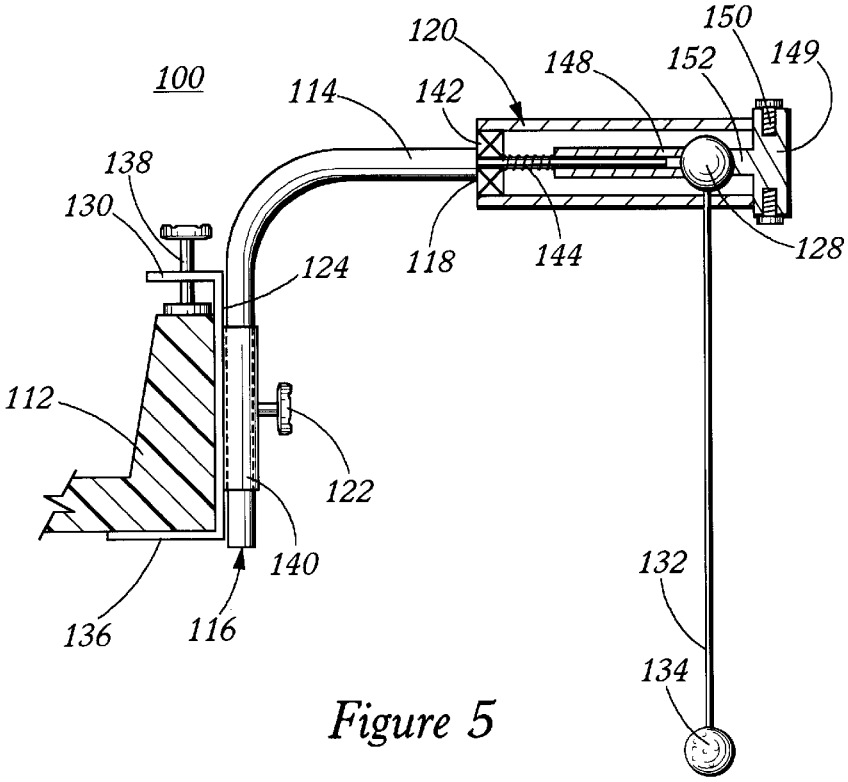
FIG. 5 illustrates a cross sectional view of another embodiment of the mobile practice device attached to a bumper by means of a C-clamp.

Referring now to FIG. 5, another preferred golf practice device 100 is shown attached to a golf cart bumper 112 with a C-clamp type vehicle attachment means. Also shown is a preferred aspect of the tethering means of the practice device which includes a hollow cylindrical body 120 rotatably mounted on a small diameter portion formed on the second end 118 of the shaft 114, wherein a golf ball 134 is connected to the tethering means by a connecting bar 132 that extends down from a steel ball 128 found inside the hollow cylindrical body 120.

The C-clamp type vehicle attachment means includes a front plate 124, an upper arm 130 extending from a top edge of the plate 124, and an anvil 136 extending from the bottom edge of the plate 124. A threaded rod 138, having an actuating handle on one end and a pad on the opposite end, extends through a threaded aperture in the upper arm 130. The practice device 100 is reversibly fixed to the bumper 112 by tightening down the threaded rod 138 on the bumper 112.

A shaft holding sleeve 140 is attached to the front plate 124 of vehicle attachment means. The shaft 114 is attached to the vehicle attachment means by inserting the first end 116 of the shaft 114 into the sleeve 140, and tightening down a threaded bolt 122, inserted through a threaded aperture in the sleeve 140, on the shaft 114. In this preferred aspect, the vertical position of the shaft 114 with respect to the sleeve 140 can be continuously adjusted along the length of the shaft 114 that is substantially perpendicular to the ground.

A small diameter portion of shaft 114, formed on the second end 118 of the shaft, connects the tethering means. The tethering means attaches to the second end 18 through a bearing 142 that is welded to the cylinder 120 so that the cylinder 120 is journalled on, and revolves around the second end 118 of shaft 114. A spring 144 is mounted about the small diameter portion in front of the bearing 142. The first support 148 is cylindrical in shape, and has a concave end facing opposite the second end 118 of the shaft 114. The small diameter portion of the second end 118 of shaft 114 inserts into a bore centered along the long axis of the first support 148 and is securely fastened to the first support 148 with a treaded bolt 150 that secures end piece 149. End piece 149 is a t-shaped container the smaller diameter of which has two screw holes to threadably engage bolts 150 in order to retain end piece 149 to the cylinder 120.

The concave side of the first support 148 faces the concave side of the second support 152 in order to form a cradle that swivelly supports the steel ball 128. The steel ball 128 is attached to the upper end of a connecting bar 132, which is attached to the golf ball 134 at its lower end.

Figure 6:
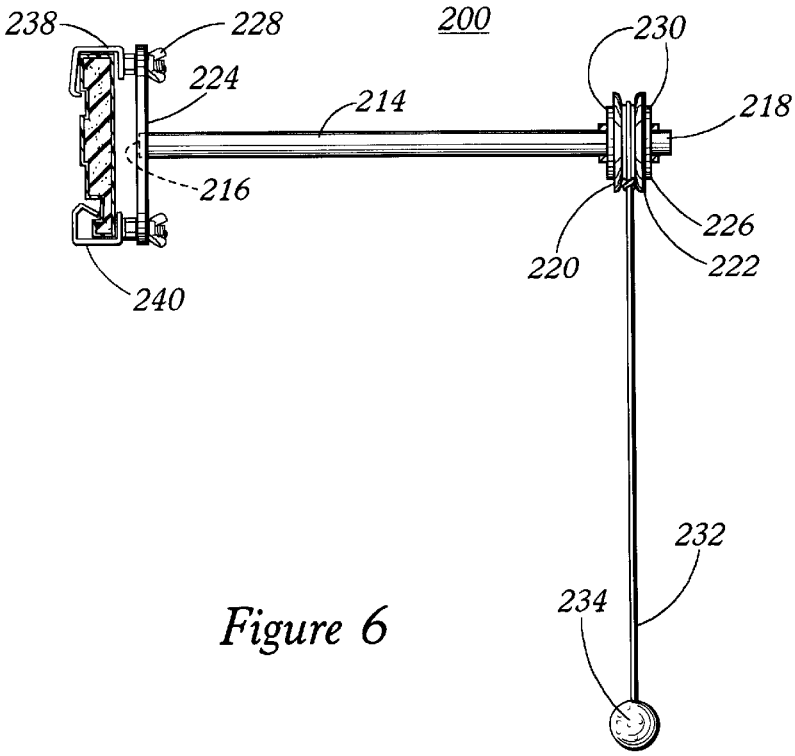
FIG. 6 illustrates a cross sectional view of another embodiment of the practice device which has a straight shaft.

Referring now to FIG. 6, another preferred aspect of the present invention is shown where the shaft 214 is strait rather than bent, and the tethering means comprises a pair of ring shaped grommets, 220 and 222, rotatably inserted proximate to the second end 218 of the shaft 214.

In this preferred aspect of the present invention, a portion of the shaft 214 proximate to the first end 216 is threaded so that it can be threadably fixed into a threaded opening on the front side of the plate 224. In this preferred aspect, the plate 224 forms part of the vehicle attachment means, and is immovably clamped to the bumper 212 of a vehicle (not shown) with mounting brackets 238 and 240, similar to those shown in FIG. 2. The mounting brackets can reversibly fix the plate 224 to the bumper 12 by the reversible tightening of wing nuts 228, located proximate to the four corners of the plate 224.

The tethering means of this preferred aspect of the invention includes a pair of ring shaped grommets, 220 and 222, that are connected together by a tubular sleeve attached to the open center portion of each grommet. A unit consisting of the grommets and the tubular sleeve is positioned rotatably upon the shaft 214, proximate to the second end 218. A pair of washers 226, encircling the shaft 214 and movably mounted thereon are positioned on opposite ends of the grommets 220 and 222. A pair of laterally spaced retainers 230 are affixed to the shaft 214, proximate to the sides of the respective washers 226, opposite the grommets 220 and 222. In this preferred aspect, the retainers 230 are pins or cotter keys inserted into transversely positioned bores formed in the shaft 214.

A flexible cord 232 is tied around the tubular sleeve between the grommets 220 and 222. A golf ball 234 is attached to the bottom end of the flexible cord 232.

The mobile golf practice device of the present invention has been exemplified with reference to the various aspects and examples described and illustrated above. By using the description of the present invention found herein, one skilled in the art may be able to design other versions of the mobile golf practice which differ from those illustrated. However, the present invention is not intended to be limited to only the described aspects and examples. Rather, the following claims, and all equivalents of these claims, define the scope of the present invention.

What is claimed is:

1. A golf cart comprising:

a golf cart to be operated on a golf course; and a mobile golf practice device including:

a practice golf ball to practice a golf stroke, wherein a golf club is used to strike said golf ball;

a support shaft having a first end and a second end, said first end being fixedly attached to the golf cart, wherein said first end points substantially perpendicular to the ground, and said second end points substantially parallel to the ground; and a golf ball tethering assembly, rotationally attached proximate the second end of the support shaft and also attached to the golf ball, for allowing the golf ball to orbit the second end of the support shaft after being struck by the golf club, wherein said tethering assembly comprises:

a bearing, fastened to said second end of the shaft, a spool, rotatably attached to the bearing, and a flexible cord having an upper end and a lower end, wherein the upper end is affixed to said spool, and the lower end is adapted for attachment to the golf ball.

2. The golf cart of claim 1, wherein said first end of said support shaft is fixedly attached, through a vehicle attachment assembly, to a bumper of the golf cart, said vehicle attachment assembly comprising:

a plate having a front side and a back side which is opposite the front side, a shaft holding structure, attached to the front side of the plate, for holding the support shaft next to the front side of the plate; and a bumper affixing structure, attached to the back side of the plate, for immovably fixing the attachment assembly to the bumper of the golf cart.

3. The golf cart of claim 1, wherein said upper end of the flexible cord is affixed to the spool by tying the cord around the spool.

4. The golf cart of claim 1, wherein said spool is positioned rotatably upon the shaft proximate to the second end, the golf ball tethering assembly further includes first and second washers encircling the shaft and movably mounted thereon at opposite ends of a grommet, and first and second laterally spaced retainers affixed to the shaft proximate the sides of the respective washers while allowing the rotational and angular movement thereof.

5. A golf cart comprising:

a golf cart to be operated on a golf course; and a mobile golf practice device including:

a practice golf ball to practice a golf stroke, wherein a golf club is used to strike said golf ball;

a vehicle attachment assembly for attachment to a bumper of a golf cart, wherein said vehicle attachment assembly includes a plate, having a front side, and a back side facing opposite the front side, for mounting a shaft to the bumper of the golf cart, and a mounting bracket, attached to the back side of the plate, for immovably clamping the mobile golf practice device to the bumper of the golf cart;

a support shaft having a first end and a second end, said first end being fixedly attached to said attachment assembly, wherein said first end points substantially perpendicular to the ground, and said second end points substantially parallel to the ground, wherein said shaft is attached to the front side of the plate by a shaft holding bracket which clamps the shaft against the plate; and a flexible golf ball tethering assembly including a bearing, fastened on the second end of the shaft, an oblate spool, rotatably attached to the bearing, and a flexible cord having an upper end and a lower end, wherein the upper end is tied around said spool, and the lower end is attached to the golf ball.

6. A method of practicing a golf stroke comprising:

swinging a golf club to strike a practice golf ball of a mobile golf practice device to set said golf ball into rotational motion, the mobile golf practice device including said golf ball;

a rigid L-shaped, one-part support shaft having a first end and a second end, said first end being fixedly attached to a golf cart, wherein said first end points substantially perpendicular to the ground, and said second end points substantially parallel to the ground; and a golf ball tethering assembly, rotationally attached proximate the second end of the support shaft and also attached to the golf ball, for allowing the golf ball to orbit the second end of the support shaft after being struck by the golf club, wherein said tethering assembly comprises:

a bearing, fastened to said second end of the shaft, a spool, rotatably attached to the bearing, and a flexible cord having an upper end and a lower end, wherein the upper end is affixed to said spool, and the lower end is adapted for attachment to the golf ball; and observing the rotational motion of the golf ball rotating about the second end of the support shaft, wherein a rotational speed of the golf ball is reflective of the force of the golf stroke, and a rotational plane orientation of the golf ball with respect to the second end of the support shaft is reflective of the direction of travel of the golf ball.

7. The method of claim 6, wherein the mobile golf practice device further includes a vehicle attachment means, which comprises:

a plate having a front side, and a back side which is opposite the front side;

a shaft holding means, attached to the front side of the plate, for holding the shaft next to the front side of the plate; and a bumper affixing means, attached to the back side of the plate, for immovably fixing the attachment means to a bumper of the golf cart.

* * * * *